United States Patent [19]

Divisek et al.

[11] Patent Number: 4,636,291

[45] Date of Patent: Jan. 13, 1987

[54] DIAPHRAGM FOR ALKALINE ELECTROLYSIS AND PROCESS FOR MANUFACTURE OF DIAPHRAGM

[75] Inventors: Jiri Divisek; Peter Malinowski, both of Jülich, Fed. Rep. of Germany

[73] Assignee: Kernforschungsanlage Jülich Gesellschaft mit beschränkter Haftung, Jülich, Fed. Rep. of Germany

[21] Appl. No.: 750,858

[22] Filed: Jul. 1, 1985

[30] Foreign Application Priority Data

Jun. 30, 1984 [DE] Fed. Rep. of Germany ..... 3424203

[51] Int. Cl.[4] ..... C25B 11/03

[52] U.S. Cl. ..... 204/283; 204/295; 427/180; 428/312.6; 428/312.8; 428/141

[58] Field of Search ..... 204/295, 283; 427/180; 428/304.4, 242, 316.6, 317.9, 328, 329, 469, 472, 312.6, 312.8, 141, 256

[56] References Cited

U.S. PATENT DOCUMENTS

| | | | |
|---|---|---|---|
| 1,082,286 | 12/1913 | Ruhm | 204/295 |
| 4,032,427 | 6/1977 | Kadija | 204/295 |
| 4,073,999 | 2/1978 | Bryan et al. | 428/312.8 |
| 4,356,231 | 10/1982 | Divisek et al. | 428/304.4 |
| 4,394,244 | 7/1983 | Divisek et al. | 204/295 |
| 4,457,832 | 7/1984 | Asano et al. | 204/283 |
| 4,476,002 | 10/1984 | Howard et al. | 204/283 |
| 4,498,942 | 2/1985 | Asano et al. | 204/283 |
| 4,559,124 | 12/1985 | Divisek et al. | 204/295 |

OTHER PUBLICATIONS

Developments on Ime–Alkaline Water Electrolysis by H. Vandenborre, R. Leysen and H. Nackaerts, published by Int. J. Hydrogen Energy, vol. 8, No. 2, pp. 81–83, 1983.

*Primary Examiner*—R. L. Andrews
*Attorney, Agent, or Firm*—Nils H. Ljungman

[57] ABSTRACT

A diaphragm for alkaline electrolysis, specifically for alkaline electrolysis of water, comprises a fine-pored, predominantly ceramic layer, which is preferably supported by a superficially oxidized structural framework or mesh. The diaphragm in use is sandwiched between two electrodes and is provided, on one or both sides, with fairly coarse-grained protuberances distributed over the surface and embedded into the fine-pored predominantly ceramic layer, which grains project out of the diaphragm surface. In view of the projection of the grains to form protuberances, and in spite of the fact that the adjacent electrodes are in contact with the diaphragm, a certain minimum distance is maintained between the diaphragm and each electrode, whereby, deposits on the electrodes, caused by unavoidable corrosion phenomena within the electrolysis apparatus, cannot propagate into the diaphragm. These coarse grains, about 10–250 microns in size, are thinly distributed over the diaphragm surface during the manufacture of the diaphragm before sintering, and are caused to be embedded in the surface with a slight application of pressure, so that they stick out in the form of "nubs", resulting in reduced energy consumption during electrolysis.

20 Claims, 5 Drawing Figures

DIAPHRAGM FOR ALKALINE ELECTROLYSIS AND PROCESS FOR MANUFACTURE OF DIAPHRAGM

CROSS REFERENCE TO CO-PENDING APPLICATIONS

Co-pending application Ser. No. 613,877, filed on May 24, 1984, entitled "An Improved Nickel Oxide Based Diaphragm" now U.S. Pat. No. 4,554,124; co-pending application Ser. No. 644,829, filed on Aug. 27, 1984, entitled "Activated Electrodes" now U.S. Pat. No. 4,584,065. Further application Ser. No. 648,898, filed on Sept. 10, 1984, entitled "Hydrogen Permeation Membrane, Process for its Manufacture and Use" now U.S. Pat. No. 4,589,891; application Ser. No. 649,043, filed on Sept. 10, 1984, entitled "Hydrogen Permeation Membrane"; and application Ser. No. 750,909 to be filed on June 30, 1985, entitled "Process And Apparatus For Conversion of Water Vapor With Coal or Hydrocarbon Into a Product Gas", all assigned to the same assignee as the instant application are not deemed as especially relating to the present case.

FIELD OF THE INVENTION

The invention generally relates to a diaphragm for alkaline electrolysis and, more particularly, to a diaphragm for alkaline electrolysis of water. The invention also concerns a process for the manufacture of the diaphragms.

Diaphragms as developed by the applicant for the alkaline electrolysis of water present special advantages, having a fine-pored insulating nickel-oxide base layer formed by oxidation of sintered metal or pressed metal powder on a metallic structural support the surface of which is likewise oxidized in an oxidation step. The invention as described herein relates largely to these special diaphragms.

DESCRIPTION OF THE PRIOR ART

As known in prior art, alkaline electrolysis of water is generally carried out using asbestos diaphragms in hot KOH at relatively low temperatures below 90° C. Such relatively low temperatures are necessary on account of the low chemical resistance of commercially-used asbestos diaphragms in hot KOH. Practically, the diaphragms would have to be made far thicker, for reasons of stability, than would be necessary for the electrolysis itself. The undue thickness of the diaphragm requires an undesirably high electrolysis voltage and makes the entire process uneconomical from the point of view of energy consumption.

Numerous tests have therefore been undertaken to improve the resistance of asbestos in hot lye and to find other suitable substitute diaphragm materials. Locating suitable substitute diaphragm materials, however, has not been hitherto easily possible, in spite of years of intensive efforts, without a separator on the basis of polyantimonic acid, as discussed, for example, in Int. J. Hydrogen Energy 8 (1983), pages 81–83.

The applicant, however, has developed usable porous diaphragms on a nickel oxide basis, which are obtained by oxidation of sintered metal at high temperature, as disclosed generally in German DE-OS 29 27 566 (U.S. Pat. No. 4,394,244), or more simply by the oxidizing integration of a nickel powder layer pressed onto a support, as discussed generally in German DE-OS 30 31 064 (U.S. Pat. No. 4,356,231). The chemical stability of these diaphragms was further improved by the added presence of a certain level of titanium oxide as taught, for example, in German Patent Application No. P 33 18 758.4-41 (U.S. Ser. No. 613,877 filed 05/24/1984). All of the above-cited publications are incorporated herein by reference.

These new diaphragms on a nickel oxide base have generally an excellent chemical resistance in hot KOH, excellent separation characteristics with regard to the two product gases, $O_2$ and $H_2$, and an extraordinarily low electrical resistance, all of which make possible an energy-economical execution of the electrolysis. The latter property is used to special advantage if electrodes of thin perforated sheet metal or a thin active porous layer are connected in a so-called sandwich directly with the diaphragm. With such electrodes with a "zero distance" from the diaphragm, cell voltages are achieved which suffice even for very high energy saving requirements. This sandwich arrangement of electrodes and diaphragm, which eliminates any unnecessary additional electrode separation, is far superior from an energy requirement point of view to all previous commercially known prior art arrangements.

Known prior art arrangements have heretofore been constructed either with sheet metal configures in the form of louvers, or a type of rib mesh or slotted sheet metal. Consequently, in prior arrangements, in the region between the diaphragm and the electrochemically active main portion of the electrode, there has always been a certain spacing on the order of several mm, which spacing represents an additional electrical resistance and thereby leads to energy losses in comparison with the "zero distance" concept.

However, the "sandwich structure" also has a functional disadvantage which is absent in the ordinary prior art structures which are functionally satisfactory, but energetically more wasteful. The diaphragm can remain functional only if the diaphragm pores are not blocked, and only if no deposits are caused to be formed on the electrodes. The electrode deposits deleteriously propagate into the diaphragm which is located in the immediate vicinity, especially if the diaphragm is at zero distance. Naturally, it would require that the entire cell system including the periphery must be corrosion-resistant so that practically no corrosion takes place. Corrosion products would, as a result of the electrode reactions, either precipitate or be deposited cathodically as metals or anodically as oxide hydrates, and would grow from the electrodes into the diaphragm blocking it's pores or even leading to short circuits. In practice, however, it is very difficult or at least very expensive and commercially uneconomical to maintain corrosion-free conditions.

In other words, the reduction of electrode distances, which is on the one hand energy-favorable and therefore economical, is linked with operational problems of the diaphragm becoming disfunctional, whereas the prior art solution incorporating a certain distance between diaphragm and electrodes is cheaper and functionally satisfactory, but less advantageous and less economical for an energy standpoint.

OBJECTS OF THE INVENTION

An object of the invention, therefore, is to provide an arrangement in which the energy losses caused by the distance between the diaphragm and electrode are minimal. Another object is to provide an arrangement in which structural materials can be used for the cell and periphery which provide sufficient corrosion-resistance at a reasonable price. Further, although the structural materials need not prevent corrosion entirely, they prevent corrosion substantially.

These objectives are achieved with a diaphragm of the type described above, improved by the invention, wherein coarse grained protuberances are distributed over the diaphragm surface, the protuberances being integrated into and embedded in the fine-pored surface of the diaphragm. The protuberances may be provided to project from the surface on one or both sides of the diaphragm.

Preferably, the diaphragm comprises a structural framework for the fine-pored layer, which is specifically formed by a partially oxidized metal mesh, which makes it possible to use thin diaphragms with a large surface area.

SUMMARY OF THE INVENTION

The invention in its broad form comprises a diaphragm and a manufacturing process therefor. The diaphragm is used for alkaline electrolysis, especially the alkaline electrolysis of water. The diaphragm comprises a fine-pored predominantly ceramic layer having surfaces, including at least one main side surface, and a plurality of protuberances projecting outwardly by predetermined dimensions from at least one main surface of the diaphragm. The protuberances comprise a plurality of coarse grains of known dimensional sizes embedded in and integrated into said at least one side surface of the diaphragm.

In use, the diaphragm is sandwiched between two electrodes. The electrodes are no farther from the ceramic layer surface than the predetermined dimensions of the protuberances, thereby ensuring minimized energy requirements for electrolysis.

In a preferred embodiment of the invention described herein, the diaphragm comprises a fine-pored sheet, which is formed by oxidation of sintered metal or pressed metal nickel-base powder until a layer is achieved which has sufficient electrical isolation properties, especially on a partially oxidized metal mesh support (the surface of which is oxidized during oxidation), wherein the coarse grains projecting out of the diaphragm layer comprise oxidized metal.

On such a "fine nap" diaphragm, the coarse grains projecting from the surface provide a certain minimum distance between the fine-pored diaphragm itself and a directly adjacent electrolyte-permeable or gas-permeable electrode made of perforated sheet metal or a similar material, so that the diaphragm remains usable over long periods of time, even under conditions in the electrolyte cell which are not absolutely corrosion-free. At the same time, the distance of the electrodes from the fine-pored diaphragm layer, which distance can be adjusted by means of the grain size and the projecting portion of the grains, is small enough so that significant energy losses in the electrolysis operation do not occur.

Generally, the coarse grains have a diameter of approximately 10 to 250 microns (1 micron$=10^{-6}$ meters), the preferred range of diameter being from 50 to 150 microns, and the grains preferably project out of the diaphragm surface about 50 to 70%. They are relatively sparcely and usually randomly distributed over the diaphragm surface, since the stability and thickness of the electrode generally prevent "sagging" between the support points, which can thereby be relatively far from one another.

The average center-to-center distance of the coarse grains, which are disposed to form a microspacer layer, is appropriately chosen, and is approximately up to 100 times the grain diameter, although the preferred center-to-center grain distances are in the range of 10 to 50 times the grain diameter.

The coarse grains integrated into the fine-pored diaphragm layer according to the invention comprises, for example, oxidized metals and are "baked" into the layer during the manufacture of the diaphragm. Coarse-grain powders of iron, cobalt, nickel or mixtures of these elements are preferred and are appropriately used for manufacture.

The manufacture of the diaphragm is preferably done by oxidizingly sintering, on the fine-pored layer of the diaphragm itself, another metal powder with a coarser grain along the surface. Specifically, in a first stage, a fine-grain metal powder with a grain size about 1 to 5 microns, for example, is compressed on a mesh as a support, specifically on a nickel mesh support, by means of a pressing or rolling process. On the fine-pored metal powder layer formed in this manner, a metal or metal oxide powder with a coarser grain size, for example, 10 to 250 microns, is sparcely distributed and is then pressed or rolled with a light application of pressure. The coarse metal powder is thereby preliminarily embedded and fixed in the finely-porous layer. In this manner, small "nubs" are formed, which project above the surface of the fine-pored layer. This assembly is subjected to oxidizing in a further step, so that the metal structure is largely transformed into an oxidic diaphragm but saving a supporting tough metallic core.

BRIEF DESCRIPTION OF THE DRAWINGS

A more detailed understanding of the invention may be had from the following description of preferred embodiments, given by way of example and to be understood and read in conjunction with the accompanying drawing wherein.

DESCRIPTION OF THE PREFERRED EMBODIMENTS

The inventive diaphragm described hereinafter is an improved fine-pored nickel oxide base diaphragm comprising a structure formed by oxidation of an assembly of a sintered metal layer or of a pressed metal powder layer on a metallic structural support. During such an oxidation to obtain sufficient insulating characteristic, fine grained metal is oxidized more rapidly than the supporting metallic structure, the surface of which is, of course, likewise oxidized. Such an oxidation of this surface and of the fine grains results in an integration of all elements, including any coarse grains, into a coherent unit. The performance and energy efficiency of prior art electrolysis operations can be substantially improved by the inventive structure of the present diaphragm wherein protuberances of predetermined size are provided at a predetermined spacing at least on one surface of the diaphragm.

Figure 1:
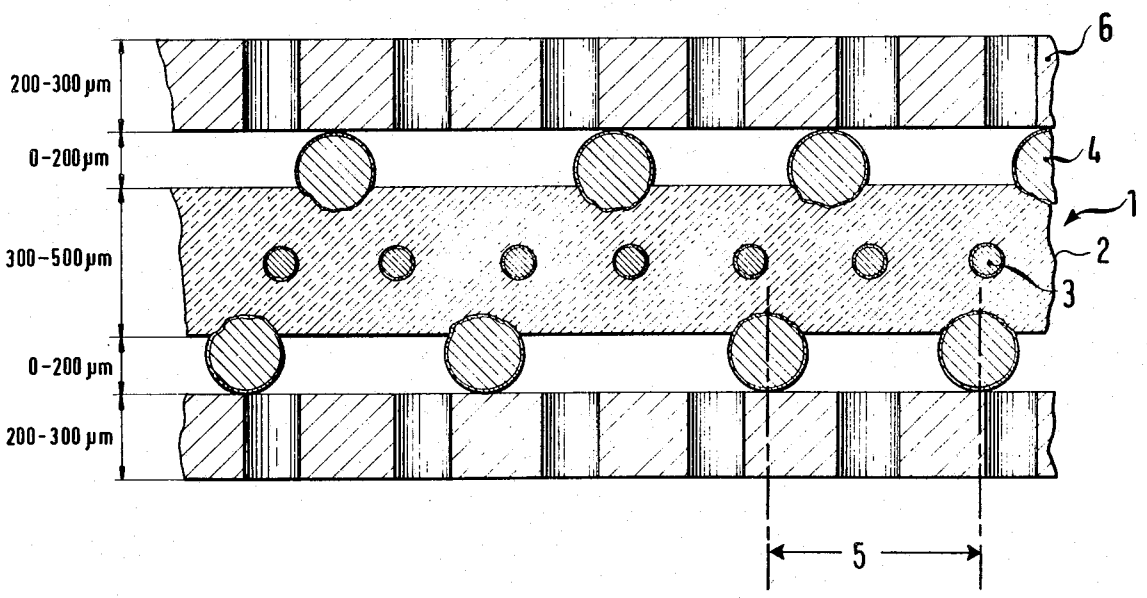
FIG. 1 diagrammatically illustrates the diaphragm described by the invention with electrodes.

As illustrated, FIG. 1 shows schematically the diaphragm 1 with a fine-pored layer like structure formed over a mesh-like support 3. Coarse grains 4 with a predetermined center-to-center distance are baked into and embedded to form "nubs" at least on one side surface of the fine-pored structure 2.

On the diaphragm formed in this manner, with "nubs" on one or both sides, electrodes 6, which are gas-permeable and electrolyte-permeable and comprising, for example, perforated sheet metal or porous, galvanically-produced thin electrodes, are assembled in use. The electrodes 6 are held at a predetermined spacing or distance 5 from the diaphragm by the "nubs" or protuberances.

Nickel powder and a nickel support may be preferably used for the manufacture of the diaphragm, and for the "nubs", or microspacers, coarse grain powders of metals, which on the basis of a comparable reaction heat and thermal behaviour during the oxidation process can be oxidized together with the pressed and ointorod layer, and can thereby be integrated into the fine-pored layer of the diaphragm. Expediently, the coarse grain powder can be pressure molded into the fine-pored layer 2 of the diaphragm 1. Instead of metallic coarse grains, oxidized during oxidizing heat treatment, coarse grains of metal oxide could be used.

As to the manufacturing process taught by this invention, the molding pressures used in manufacturing of the diaphragm are selected according to the desired porosity and the desired depth of embedding of the coarse grains, while of course a unsintered layer, convenient for handling, should be formed.

Figure 3C:
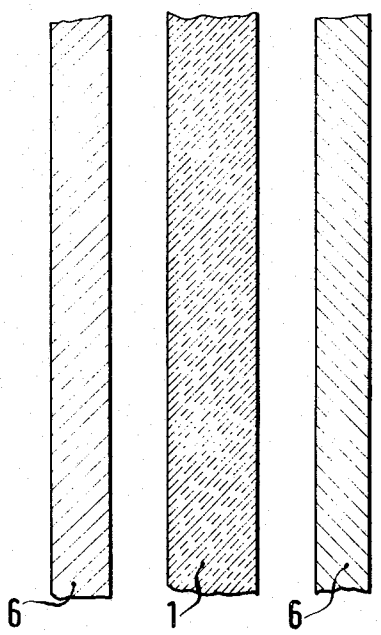
FIG. 3C PRIOR ART
FIG. 3 illustrates typical diagrammatic arrangements of diaphragm and electrodes based on the prior art.
Figure 3B:
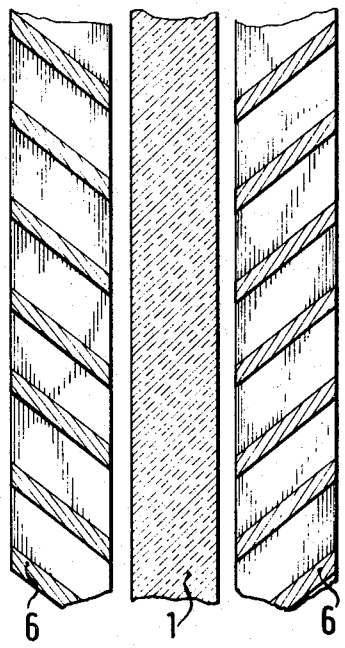
FIG. 3B PRIOR ART
Figure 3A:
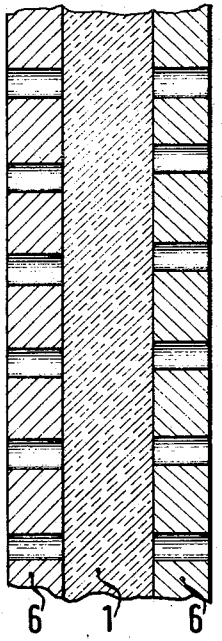
FIG. 3A PRIOR ART

FIGS. 3*a*, 3*b* and 3*c* diagrammatically illustrate arrangements of the prior art wherein the diaphragm 1, without the invention, is disposed in adjacent relationship with the permeable electrode members 6, which may take different structural forms. Whichever form the electrodes take, there is always the undesirable situation in the arrangement of 3*a* that corrosion products generated at the electrode region grow towards the diaphragm and render it disfunctional. In 3*b* and 3*c*, however, even though the diaphragm may not easily be coated with corrosion products because of the spacing, there is still the undesirable feature that a very high electrolysis energy requirement is to be met.

On the left edge of FIG. 1, preferred dimensions of an embodiment of the invention are indicated, and it can be seen that the distance of the electrode from the diaphragm itself can be variably selected up to specifically 200 microns, depending on the grain size and the impression pressure, when the coarse grains are applied. The fine-pored diaphragm structure thereby is kept away form the electrode only as far as is necessary to prevent deleterious side effects of the electrodes on the diaphragm during the electrolysis operation, while retaining advantageously low diaphragm-electrode distances.

Figure 2:
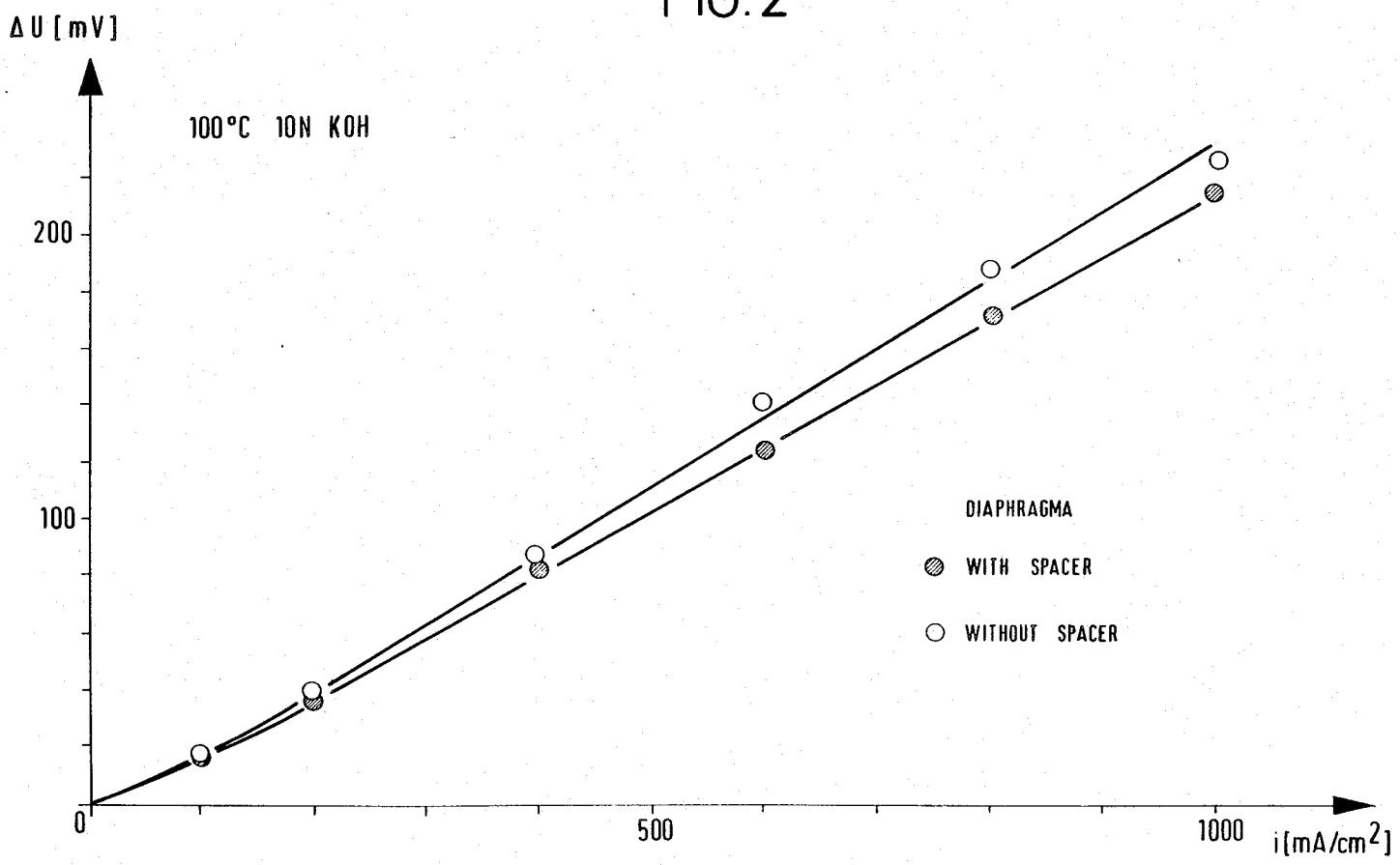
FIG. 2 diagrammatically shows curves for the ohmic voltage drop through the cell as a function of current density.

In other words, the advantages of the low cell voltages which can be achieved with electrodes up against the diaphragm remain practically unchanged, as shown in FIG. 2, and at the same time, deleterious metal deposits, undesirable chemical effects of the electrolysis products and intermediate products on the diaphragm are substantially minimized. Also, a direct action on the diaphragm by the electrodes themselves or an excessively intensive diffusion through the diaphragm are largely prevented.

In this context, it is very important to note that the "microspacers" or "nubs" formed as described above have no hydrophobic properties and are therefore advantageous especially for gas-generating electrochemical processes, since no damaging side effects on the cell voltage can occur as a result of the so-called "bubble curtain" effect.

The following example describes a process for the manufacture of a diaphragm in accordance with the invention:

EXAMPLE

By means of a plastic screen using, for example, a pressure screen process, and a mesh PES 12–15, a suitable quantity of dry nickel powder, INCO® 255, was distributed uniformly on a metal plate. The amount of Ni powder was 40 mg/cm$^2$. Over the layer, a nickel mesh with a mesh width of 0.20 mm and a wire thickness of 0.125 mm was placed, and the assembly was cold-compressed with a pressing force of approximately 200 N/cm$^2$. In this manner, an assembly is obtained in the form of a nickel mesh framework with a powder layer on one side.

The process was repeated for the second side whereby the result was a diaphragm precursor of nickel mesh coated on both sides.

Iron powder with a grain size of 100 to 150 microns was then uniformly distributed over a metal plate in an amount of 10 mg/cm$^2$. The diaphragm precursor was then placed on this layer and pressed into it under light pressure of approximately 10 N/cm$^2$. The second side was treated in a similar manner.

This precursor was then treated for 15 minutes in air in a furnace at 1000° C., whereby a diaphragm with "microspacers" was obtained which was suitable for installation in an electrolysis cell with adjacent electrodes.

The chemical resistance of this diaphragm does not differ from that of a pure NiO diaphragm according to German Laid Open Patent Application No. DE-OS 30 31 064 without "microspacers", that is, the new diaphragm is very well suited for long-term operation under electrolysis conditions, and at the same time ensures energy efficiency of the elctrolysis which is performed using the diaphragm of the invention.

Other mesh sizes and materials for the making of the diaphragm may be selected by those skilled in the art and are within the purview of this invention. Other materials for forming the microspacers may be chosen so long as the materials are compatible with the diaphragm and the electrolysis process.

It is seen from the foregoing that the invention provides a novel diaphragm for alkaline electrolysis and a method of producing the diaphragm, wherein by virtue of the microspacer layer provided at least on one side of the diaphragm, electrolysis can be performed in a highly energy-efficient manner without sacrificing performance. As explained hereinbefore, in prior art arrangements, there has always been a need to maintain a substantial spacing between the diaphragm and an adjacent electrode during electrolysis. The "spacing" has invariably been provided in the prior art arrangements by louvers or a rib mesh or a slotted sheet metal structure. Even though such prior art arrangements are functionally satisfactory, they are highly uneconomical in view of the high energy consumed in performing the electrolysis. The spacing, as aforesaid, represents deleteriously high electrical resistance and results in an inordinately high energy consumption for electrolysis. The present invention obviates the prior art spacing by electrode shape by providing a layer of microspacers on at least one surface of the diaphragm whereby an electrode which can be assembled next to the diaphragm with microspacers is just close enough thereto to ensure low electrolysis energy consumption, and ensure functional continuity without harmful deposits being formed on the diaphragm and the superjacent electrode. The invention, as described hereinabove, also teaches preferred material for the diaphragm, as well as preferred material and sizes for the microspacers, and a manner of manufacture of the diaphragm.

The invention as described hereinabove in the context of the preferred embodiment is not to be taken as limited to all of the provided details thereof, since modifications and variations thereof may be made without departing from the spirit and scope of the invention.

What is claimed is:

1. An electrically isolating diaphragm for use between at least two contacting electrodes for alkaline electrolysis, said diaphragm comprising:

a fine-pored predominantly ceramic layer-like structure having at least one fine-pored side surface;

said ceramic structure having a plurality of protuberances projecting outwardly by a predetermined dimension from said at least one fine-pored side surface of said ceramic structure;

said predetermined dimension defining a spacing between said at least one fine-pored side surface and one of said contacting electrodes; and said protuberances comprising a plurality of coarse grains of known dimensional size partially embedded in said at least one fine-pored side surface of said ceramic structure.

2. The diaphragm according to claim 1 wherein said ceramic structure includes a second side surface and wherein said protuberances are disposed over said second side surface, also of said ceramic structure, said protuberances comprising oxidized metal, said protuberances being disposed at an average center-to-center distance in a range of at least ten times said known dimensional size of said coarse grains.

3. The diaphragm according to claim 2 including a mesh-like support structure to support said ceramic structure.

4. The diaphragm according to claim 3 wherein said ceramic structure comprises oxidized sintered metal.

5. The diaphragm according to claim 3 wherein said ceramic structure comprises oxidized pressed metal nickel base powder.

6. The diaphragm according to claim 2 wherein said coarse grains forming said protuberances are of a size between 10 and 250 microns.

7. The diaphragm according to claim 6 wherein said coarse grains forming said protuberances are of a size between 50 and 150 microns.

8. The diaphragm according to claim 2 wherein said protuberances are spaced on said one side surface and said second side surface with an average center-to-center distance up to approximately 100 times said known dimensional sizes of said coarse grains.

9. The diaphragm according to claim 1 wherein said outwardly projecting predetermined dimensions of said protuberances equal 50% to 70% of said known dimensional sizes of said coarse grains.

10. The diaphragm according to claim 3 wherein said coarse grain material includes one of the members of the group consisting of essentially oxidized Fe, Co, Ni and a mixture thereof, and wherein said mesh-like support structure comprises a partially oxidized Ni mesh support, and wherein said ceramic structure comprises NiO.

11. The diaphragm according to claim 10 wherein said coarse grains comprise a size range of 10 to 250 microns, and wherein said nickel powder base layer comprises particulates of size in the range of 1 to 5 microns.

12. The diaphragm according to claim 1 including at least one electrode disposed on each said at least one side surface of said ceramic structure, said at least one electrode being no farther from said corresponding side surface of said ceramic structure than said predetermined dimensions of said protuberances, thereby ensuring minimized energy requirements for electrolysis.

13. A process for the manufacture of a diaphragm for use in alkaline electrolysis of water, wherein said diaphragm in use is sandwiched on at least one side with an electrode, said diaphragm having two sides, said process comprising the steps of:

cold compressing a predetermined metal powder into a layer on at least one side of a metal-mesh structural support to form a precursor assembly of said diaphragm;

superficially introducing loosely distributed grains of relatively coarse metallic material into at least a portion of one of said at least one cold pressed metal powder layer of said diaphragm under relatively light pressure and forming partially embedded protuberances on said portion of said one side of said diaphragm; and heating said assembly in an oxidizing atmosphere for obtaining a coherent unit sufficiently oxidized to obtain insulating properties as required for a diaphragm with sandwiched electrodes.

14. The process according to claim 13 wherein said step of cold compressing said metal powder comprises compressing a nickel-powder base into said layer at a pressure of 50 to 500 Newtons/cm$^2$.

15. The process according to claim 14 wherein said step of cold compressing said metal powder comprises compressing said nickel-powder base into said layer at a pressure of approximately 300 Newtons/cm$^2$.

16. The process according to claim 15 wherein said step of superficially introducing said coarse grains comprises pressing said coarse grains into said layer under a pressure of 10 to 100 Newtons/cm$^2$.

17. The process according to claim 16 wherein said step of superficially introducing said coarse grains comprises pressing said coarse grains into said layer under a pressure of approximately 50 Newtons/cm$^2$.

18. The process according to claim 13 wherein said step of oxidation in air comprises heating said diaphragm in air for approximately 10 to 30 minutes at 1000° C.

19. Diaphragm for alkaline electrolysis of water, which diaphragm in use is sandwiched between two electrodes, said diaphragm comprising:

a fine-pored predominantly ceramic layer having two opposite surfaces;

a plurality of protuberances projecting outwardly by predetermined dimensions on said surfaces of said diaphragm;

said protuberances comprising a plurality of coarse grains of known dimensional size between 10 and 250 microns and being partially embedded in and integrated into said opposite surfaces of said diaphragm;

said coarse grains being disposed at an average center-to-center distance which has a relationship with said known coarse grain size; and disposing said first and second electrodes, in use, one on each of said opposite surfaces of said diaphragm, said electrodes being sandwiched with said ceramic layer of said diaphragm and being no farther from said surfaces of said diaphragm than said predetermined dimensions of said protuberances, thereby ensuring minimized energy requirements for said alkaline electrolysis of water.

20. Diaphragm for alkaline electrolysis of water, which diaphragm in use is sandwiched between first and second electrodes, said diaphragm comprising:

a fine-pored predominantly ceramic layer having two opposite surfaces;

a plurality of protuberances projecting outwardly by predetermined dimensions on said surfaces of said diaphragm;

said protuberances comprising a plurality of coarse grains of known dimensional size between 10 and 250 microns and being partially embedded in and integrated into said opposite surfaces of said diaphragm;

said coarse grains being disposed at an average center-to-center distance which has a relationship with said known coarse grain size; and said first and second electrodes, in use, being disposed one on each of said opposite surfaces of said diaphragm, said electrodes being sandwiched with said ceramic layer of said diaphragm and being no farther from said surfaces of said diaphragm than said predetermined dimensions of said protuberances, thereby ensuring minimized energy requirements for said alkaline electrolysis of water.

* * * * *